US005464358A

United States Patent [19]

Unger et al.

[11] Patent Number: 5,464,358

[45] Date of Patent: Nov. 7, 1995

[54] AIRFOIL JUMP SKI

[75] Inventors: William J. Unger; William McKinney, both of Toronto, Canada

[73] Assignee: Connelly Skis, Inc., Lynnwood, Wash.

[21] Appl. No.: 109,856

[22] Filed: Aug. 20, 1993

[51] Int. Cl.[6] ..... B63B 1/00

[52] U.S. Cl. ..... 441/68; 280/609

[58] Field of Search ..... 441/68, 70, 79; 280/601, 608, 609

[56] References Cited

U.S. PATENT DOCUMENTS

| | | | |
|---|---|---|---|
| 2,716,246 | 8/1955 | Billingham | 441/79 |
| 3,096,530 | 7/1963 | Almgren | 280/601 |
| 3,501,160 | 3/1970 | Lange | 280/609 |
| 4,083,577 | 4/1978 | Ford | 280/609 |
| 4,795,386 | 1/1989 | LaPoint | 441/68 |

*Primary Examiner*—Jesús D. Sotelo

*Attorney, Agent, or Firm*—Christensen, O'Connor, Johnson & Kindness

[57] ABSTRACT

A thin top shell of aerodynamic contour is secured over a jump ski base smooth flow of air over the top of the ski during a jump, without interfering with the on-water performance of the base. The shell has a bulbous tip portion, a first portion of airfoil cross section aligned transversely of the ski in front of the central binding area of the ski, a second portion of airfoil cross section aligned transversely of the ski behind the binding area and a tail portion of airfoil cross section aligned longitudinally of the ski. The first and second airfoil cross sections have their thicker, more sharply curved sections disposed toward the inside edge of the ski, and the tail portion has its thicker, more sharply curved section disposed toward the front of the ski.

13 Claims, 10 Drawing Sheets

AIRFOIL JUMP SKI

FIELD OF THE INVENTION

The present invention relates to skis, particularly water skis used in competitive jumping.

BACKGROUND OF THE INVENTION

In the sport of water ski jumping using known jump skis, increases in jump distance have depended primarily on skier technique. For example, prior to a jump the skier sets up at the side of the wake opposite the ramp and accelerates by cutting across the wake to the ramp. It is the skier's ability to cut sharply, and to delay the cut toward the ramp to the last possible moment, which determines the skier's speed at the base of the ramp. The skier's technique also determines the extent to which the approach speed can be carried up the ramp. The skier must resist the tendency to "crush" on the ramp in order to achieve maximum take-off velocity. Jump distance also is affected by the skier's ability to assume and maintain the proper stance in the air, preferably with the skis splayed at a substantial, consistent angle until just before landing.

There have been improvements in ski design affecting jump distance, such as the use of advanced fiber-reinforced composites which affects the weight, strength and flex characteristics of the skis. However, the general shape of known jump skis has remained remarkably unchanged over the years. Jump skis typically are of substantially constant thickness with substantially flat tops and flat bottoms. Known jump skis have a gradual upward curvature at the tail and a sharper upward curvature at the tip; and known skis have a slight taper in width from the area of the toe of the binding toward the tail. In general, the shape of known skis has been determined primarily based on the severe on-water conditions encountered by the skier. The skis must permit skiing on the water at speeds approaching 70 miles per hour at the base of the ramp (as compared to a towing speed of 35 miles per hour). The skis also must permit the extremely sharp cut to the ramp and withstand abrupt forces applied by engagement with the ramp and with the water when landing.

SUMMARY OF THE INVENTION

The present invention provides an improved jump ski having the same on-water performance as known skis, i.e., with virtually no change in the bottom contour and minimal change in edge contour. Similarly, the shape of the ski viewed in plan is essentially unchanged. However, the top of the ski is designed with aerodynamic considerations in mind. In the preferred embodiment the improved ski has a thin top fairing or shell secured over a conventional base which can be a known composite jump ski.

The fairing or shell has a bulbous tip portion of generally semi-elliptical transverse cross section to induce essentially laminar airflow over the upturned tip, thereby reducing turbulence and drag. Such bulbous portion of the shell continues rearward to approximately the location where the tip of the ski begins its sharper upward curvature which can be about one-fifth the length of the ski from the tip. From such location rearward to the area of the toe of the binding, the shell is of airfoil cross section with the chord of the airfoil extending transversely and the thicker more sharply curved portion of the airfoil disposed toward the inside edge of the ski. More specifically, the thicker more sharply curved portion of the airfoil is disposed toward the right edge of the left ski and toward the left edge of the right ski. Consequently, the skis are mirror images of each other, neither being symmetrical about its longitudinal centerline, and neither being able to be substituted for the other. Rather, the right ski is dedicated to the right foot of the skier and the left ski is dedicated to the left foot of the skier.

The front airfoil portion of the ski, which can extend approximately another one-fifth of the length of the ski, ends in the area of the binding where the shell lies flat over and in substantially contiguous engagement with the flat base of the ski so as not to interfere with installation of a conventional binding. The binding area can constitute about another one-fifth of the length of the ski. Behind the binding area, the shell is again airfoil shaped, oriented transversely like the forward airfoil section, but of lesser height and tapering in height toward the tail for approximately another one-fifth of the length of the ski. The tail portion of the ski includes a narrow flat section of the shell closely overlying the top of the ski body and, to the rear of such flat section, another airfoil shaped section, but the tail airfoil section has its chord extending longitudinally of the ski with the more sharply curved and thicker portion of the airfoil disposed toward the front.

To prevent laminar flow of water over the front foil-shaped portion of the ski, a short baffle strip can be secured along the inside edge of the ski from about the toe of the binding area to the tip. The baffle strip has an abrupt corner spaced outward from the aerodynamic shell.

In the air, the shaping of the upper surface of the ski greatly reduces drag and increases lift. At the tip, turbulence is substantially reduced and airflows much more smoothly over the upper surface and then downward along the top of the shell. With the skis in the desired splayed relationship, there is transverse airflow angled across the leading airfoil section of the ski in front of the binding to generate lift. The binding, which is oriented longitudinally, creates some turbulence and may tend to straighten the airflow. Nevertheless, there still is some transverse component to air passing behind the boot which is utilized to increase lift in the transversely oriented airfoil section of the ski directly behind the boot. At the tail of the ski, airflow is substantially longitudinal of the ski. Consequently, the foil-shaped tail portion, which is oriented longitudinally, provides increased lift at the tail.

Thus, without negatively affecting the on-water performance, the in-the-air aerodynamic performance is enhanced, thereby increasing the maximum jumping distance that can be attained with the improved ski as compared to the distance attainable with known skis.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
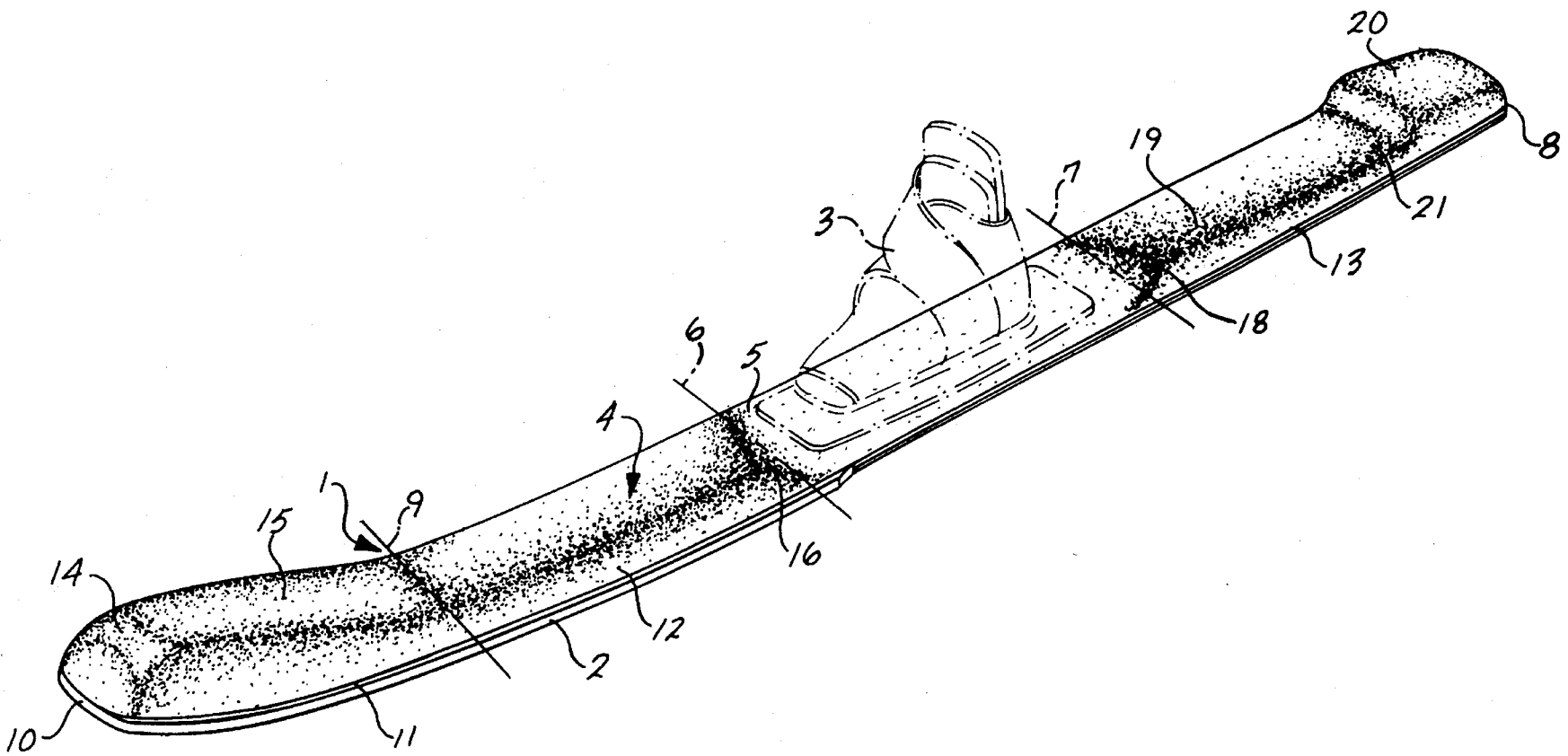
FIG. 1 is a top front perspective of an airfoil jump ski in accordance with the present invention.
Figure 2:
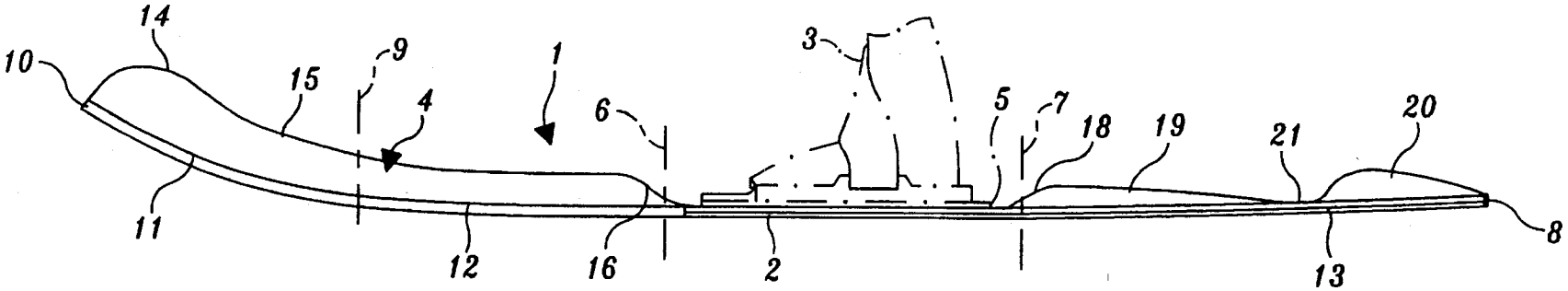
FIG. 2 is a side elevation of the jump ski of FIG. 1.
Figure 3:
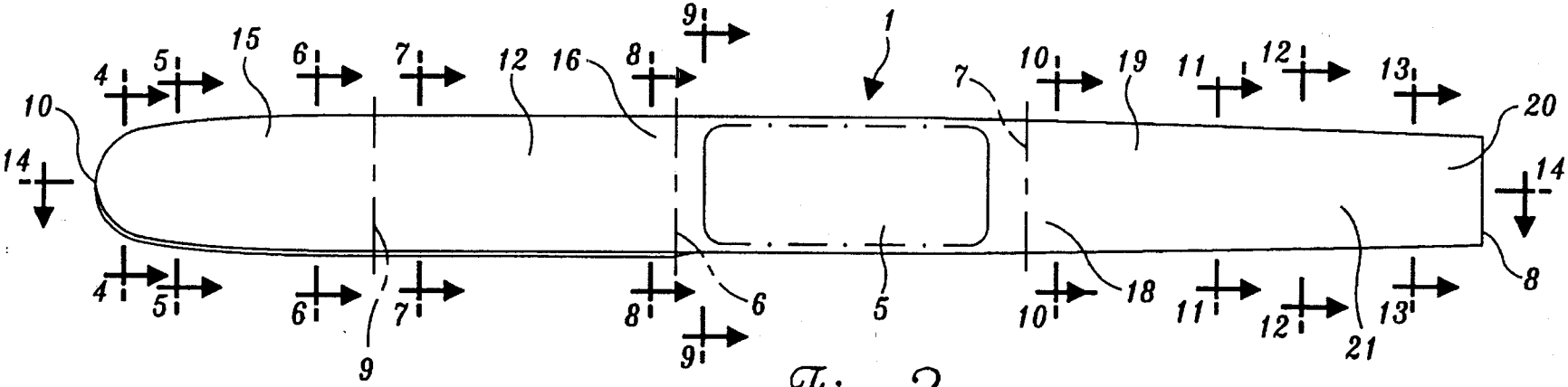
FIG. 3 is a top plan of the jump ski of FIG. 1.

With reference to FIGS. 1–3, the airfoil jump ski 1 in accordance with the present invention has a base 2 and binding 3 of conventional design. However, the upper surface of the ski is contoured aerodynamically, preferably by providing a contoured top fairing or shell 4 secured over the base 2. The result is a jump ski which has an enhanced in-the-air performance, i.e., decreased drag and increased lift, without affecting the on-water performance. To maximize aerodynamic efficiency, the leer and right skis are not symmetrical about their centerlines. Consequently, the skis are not interchangeable. In FIGS. 1—3, and the sectional views, FIGS. 4–15, the right ski is illustrated. The left ski is the mirror image of the right.

The base 2 of the improved ski 1 can itself be a conventional jump ski formed of fiber-reinforced composite. In the illustrated embodiment, the ski is about 73 inches long. As for known jump skis, the base 2 can be of substantially uniform thickness throughout its length, approximately ⅝ inch to ¾ inch thick. Viewed in profile (FIG. 2) the binding area 5 of the ski, the area between the leading (toe) and trailing (heel) reference planes 6 and 7, has substantially planar top and bottom surfaces. From the heel reference plane 7 to the tail 8 of the ski the base 2 is curved very gradually upward. Similarly, there is a very gradual upward curvature to the base from the toe reference plane 6 forward for a substantial distance to a leading reference plane 9. The tip portion of the ski, from reference plane 9 forward, is curved more sharply upward to the tip 10. In the representative ski shown in the drawings the bottom of the ski tip 10 is approximately four inches above the plane defined by the bottom of the binding area 5, and the bottom of the tail 8 is approximately one inch above the plane defined by the bottom of the binding area.

In plan (FIG. 3) the ski is narrowest at its tail 8 which can be about six inches wide. The ski gradually increases in width from the tail 8 to approximately reference plane 7 at the heel end of the binding area 5. At such location the width of the ski can be about seven inches. The gradual increase in width continues from reference plane 7 forward, up to reference plane 9 where the tip portion of the ski begins its sharper upward curvature. At such location the width of the ski can be about seven and one-half inches. From reference plane 9 forward the ski decreases in width gradually to the substantially semicircular rounded tip 10.

Based on the profile shape of the conventional base 2, the ski can be considered to be divided into four different sections. The tip section 11 consists of the upwardly curved or inclined portion of the ski from reference plane 9 forward. In the illustrated embodiment such tip portion 11 is about 14 to 15 inches long, i.e., about one-fifth the length of the ski. An intermediate leading section 12 of the ski extends from reference plane 9 rearward to reference plane 6 at the toe end of the binding area 5. In the illustrated embodiment, section 12 also extends about 14 to 15 inches. Binding area 5, between reference planes 6 and 7, extends about 15 to 16 inches. The tail section 13 of the ski, from reference plane 7 rearward, extends about 26 to 27 inches in the illustrated embodiment, i.e., about two-fifths the length of the ski.

The top fairing or shell 4 is contoured differently in each of the different sections of the ski based primarily on aerodynamic considerations. In general, the tip section 11 of the shell has a bulbous, blimp-like nose 14 disposed toward the tip, and a transition section 15 of approximately the same length as the nose portion blending the nose portion rearward to the contour of the intermediate leading portion 12. At reference plane 9, the shell 4 is of airfoil shape with the airfoil contour aligned transversely of the ski. From reference plane 9 rearward almost to reference plane 6, the airfoil contour of the ski is uniform. The short trailing portion 16 of the intermediate leading section 12 is beveled abruptly downward to meet the top of the binding section 5. In the area of binding section 5, the shell 4 is planar, closely overlying the base 2. The tail portion 13 is of more complicated contour and includes a short beveled leading portion 18 inclined from binding section 5 upward to meet a transversely aligned airfoil portion 19 which tapers in height toward the tail of the ski. However, another airfoil contoured section 20 is provided adjacent to the tail 8, but in this case aligned lengthwise of the ski with the thicker more sharply curved portion of the airfoil disposed toward the front.

Figure 4:
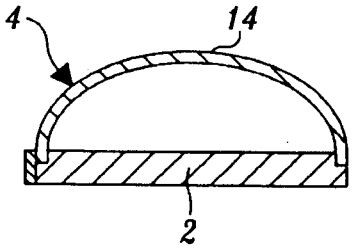
FIG. 4 is a transverse section along line 4—4 of FIG. 3.
Figure 5:
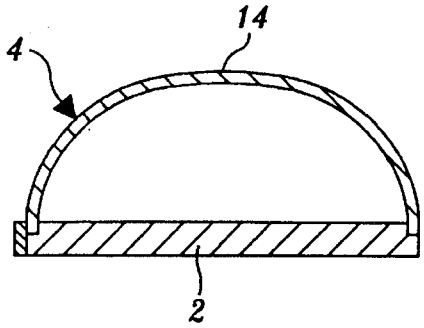
FIG. 5 is a transverse section along line 5—5 of FIG. 3.
Figure 6:
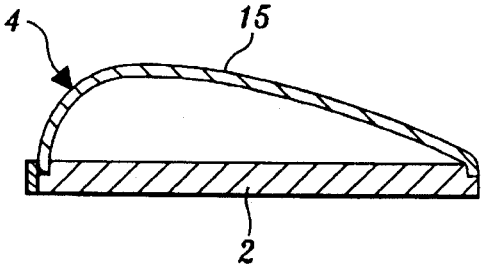
FIG. 6 is a transverse section along line 6—6 of FIG. 3.
Figure 7:
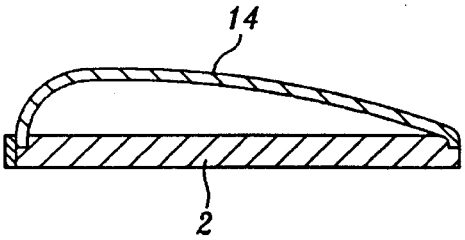
FIG. 7 is a transverse section along line 7—7 of FIG. 3.

The contour of the top shell 4 at different locations along the length of the ski is shown in more detail in the sectional views of FIGS. 4–14. As seen in FIGS. 4 and 5, the bulbous nose 14 of the shell has a semielliptical transverse cross section with the major axis of the ellipse extending horizontally and of a length approximately equal to the width of the ski base 2. In the illustrated embodiment, the maximum height of the nose portion 14 is approximately three inches measured from the upwardly curved bottom of the ski to the top of the shell. The bulbous nose portion of the ski is one of the few portions that are symmetrical about the longitudinal centerline of the ski. With reference to FIG. 7, the contour of the top shell a substantial distance behind the bulbous nose (from reference plane 9 shown in FIGS. 1, 2, and 3 rearward), i.e., in the area of the leading airfoil section 12, preferably is a true airfoil shape. In the illustrated embodiment the contour is a NACA 0017 airfoil section having a maximum height of about two inches, measured from the ski bottom to the top of the shell. With reference to FIG. 6, between the bulbous nose and the true airfoil contour, the transition section 15 of the top shell is increasingly less elliptical and symmetrical and more airfoil shaped from the nose rearward to the area represented by FIG. 7, so as to gradually fair or blend the nose section into the airfoil section.

Figure 8:
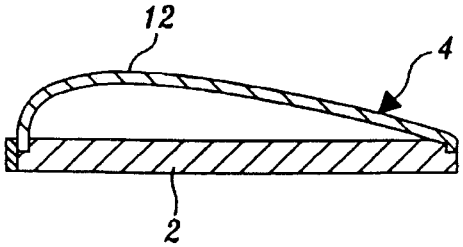
FIG. 8 is a transverse section along line 8—8 of FIG. 3.

As seen by comparing FIG. 7 with FIG. 8, the contour of the top shell is substantially uniform throughout almost all of the leading intermediate section 12.

Figure 9:
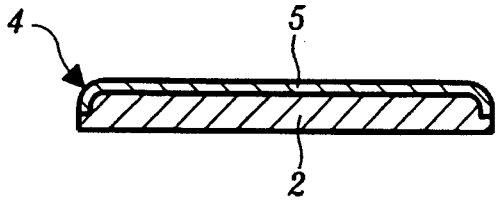
FIG. 9 is a transverse section along line 9—9 of FIG. 3.

In the binding area 5, shown in FIG. 9, the shell 4 has a substantially planar top, parallel to the planar bottom of the base 2, and in substantially contiguous engagement with the planar top surface of the base. Thus, a conventional binding can be securely fastened over the shell in the conventional manner with fasteners extending through the shell into the base.

Figure 10:
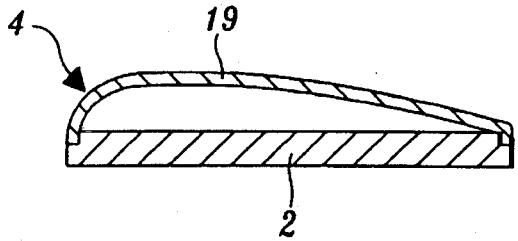
FIG. 10 is a transverse section along line 10—10 of FIG. 3.
Figure 11:
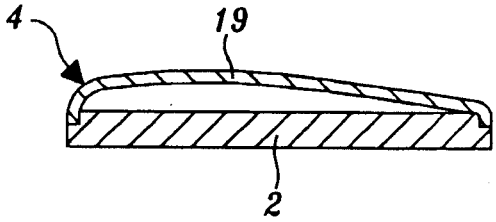
FIG. 11 is a transverse section along line 11—11 of FIG. 3.
Figure 12:
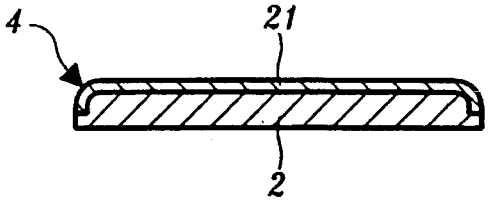
FIG. 12 is a transverse section along line 12—12 of FIG. 3.

With reference to FIGS. 10 and 11, to the rear of the binding area the transversely aligned airfoil contour (NACA 0017) is resumed, but of a maximum height of about one and one-half inches, i.e., substantially shorter than the leading airfoil section. The height of the transversely aligned airfoil section 19 decreases gradually (see FIG. 11) until the shell again has a substantially planar top surface extending parallel to the bottom surface of the base 2 and engaged against the top of the base (FIG. 12). The length of the transversely aligned airfoil contoured section 19 is about 14 to 15 inches, and the flat section 21 between the rear transversely aligned airfoil section and the tail portion can be about four to five inches long.

Figure 13:
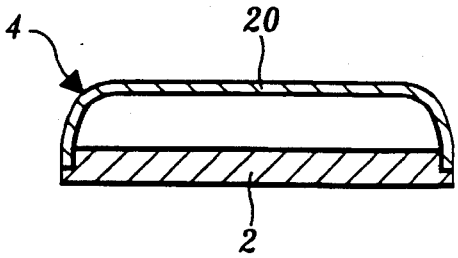
FIG. 13 is a transverse section along line 13—13 of FIG. 3.
Figure 14:
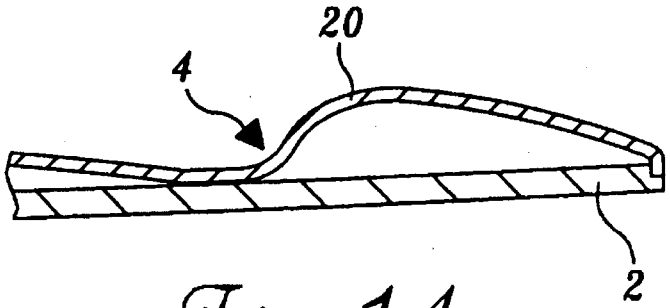
FIG. 14 is a longitudinal section along line 14—14 of FIG. 3.

With reference to FIG. 13, to the rear of the flat section 21 shown in FIG. 12, the transverse cross-sectional contour of the shell is symmetrical, having substantially linear transverse elements for the major portion of the width of the ski. However, as seen in FIG. 14, a longitudinal cross section of the tail portion 20 is of airfoil shape (NACA 0017) having a maximum height of about two inches. In other words, at the tail portion of the ski the contour of the top shell is again airfoil shaped, but aligned longitudinally of the ski rather than being aligned transversely.

Figure 15:
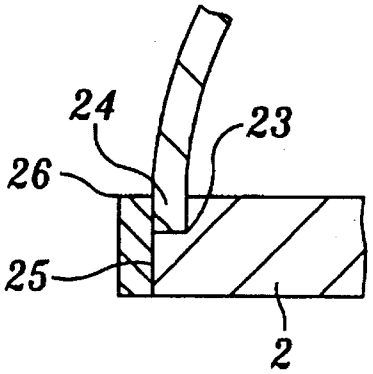
FIG. 15 is an enlarged detail transverse section of the leading portion of the inside edge of the jump ski of FIGS. 1 to 3.

To minimize the increase in weight of the ski, the shell 4 is formed of a thin reinforced plastic, such as fiberglass or graphite reinforced epoxy of a thickness of about 0.010 inch to about 0.015 inch (in the sectional views the thickness of the shell is exaggerated for ease in illustration). The base is at least several times thicker. Although substantially rigid so as to maintain its shape in the air, the thin shell preferably is sufficiently flexible so as not to interfere with the on-water performance of the base. In the contoured sections of the shell, the interior volume between the inner surface of the shell and the top surface of the base is empty. With reference to FIG. 15, preferably the top peripheral edge of the base 2 has a notch 23 for receiving the bottom peripheral edge portion 24 of the shell. The shell can be secured to the base by suitable adhesive.

When riding on the water, particularly during a high speed cut toward the ramp, the skier must be able to dig the ski edges into the water. Because the improved ski in accordance with the present invention has the airfoil shaped sections, there may be a tendency for water to flow smoothly over the top of a ski during the cut. This can affect the ability of the skier to accelerate toward the ramp. Consequently, in the preferred embodiment, a short thin baffle strip 25 is secured to the inside edge of the ski from about the toe end of the binding area to the tip of the ski. The baffle strip has a sharp top corner 26 spaced outward from the adjacent surface of the smooth shell sufficiently to assure that water does not flow smoothly over the top surface of the ski. Rather, the baffle has the affect of cutting or separating the flow of water, just as a conventional ski with its abrupt top edges prevents a smooth flow over the top of the ski. In FIG. 15, the thickness of the baffle transversely of the ski is exaggerated for purposes of illustration. The baffle need only be about one-tenth of an inch thick in order to achieve the desired separation. Preferably the bottom of the baffle strip is aligned with the bottom of the ski, and the height of the baffle strip is approximately equal to the height of the ski base.

Figure 16:
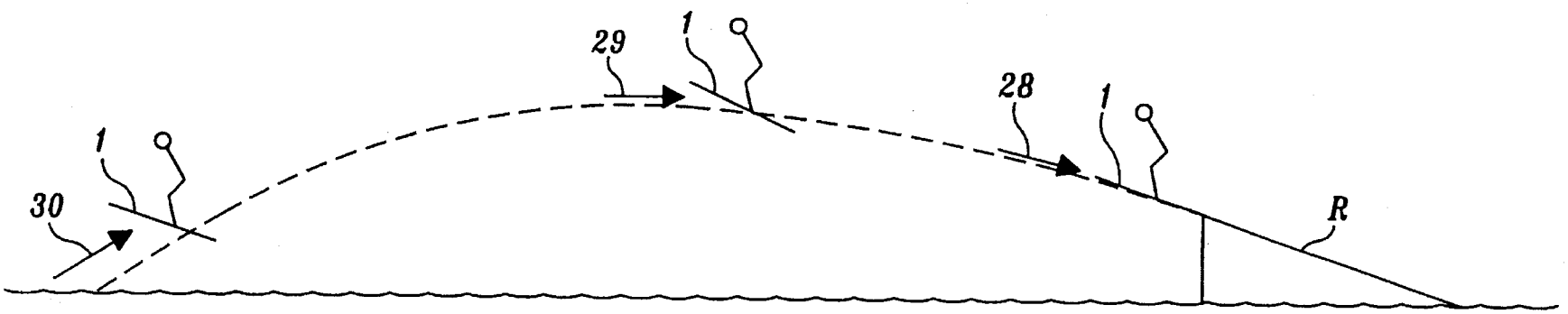
FIG. 16 is a diagrammatic side elevation illustrating the approximate orientation of jump skis at different stages of a jump.

In-the-air performance of the airfoil jump ski in accordance with the present invention is best described with reference to FIGS. 16 through 20. In FIG. 16, the distances are exaggerated for the sake of description and ease of illustration. In a representative long distance jump, the height of the ramp R would be about six feet and the length of the jump could be about 200 feet.

FIG. 16 illustrates the different angles of attack of the skis 1 at different stages of the jump. At the beginning of the jump, the direction of airflow relative to the ski, represented by the arrow 28 is almost parallel to the flat bottom of the ski. The angle of attack is nominally zero. Preferably the skier quickly brings the tips of the ski up which has the effect of increasing the angle of attack. For example, during the middle portion of jump, the direction of relative airflow is represented by the arrow 29 (substantially horizontal) as compared to the inclined attitude of the skis. As the skier approaches landing, the angle of attack can become quite large, as high as 40 degrees to 45 degrees. Arrow 30 in FIG. 16 represents the direction of airflow relative to the skis as the skier approaches landing.

Figure 17:
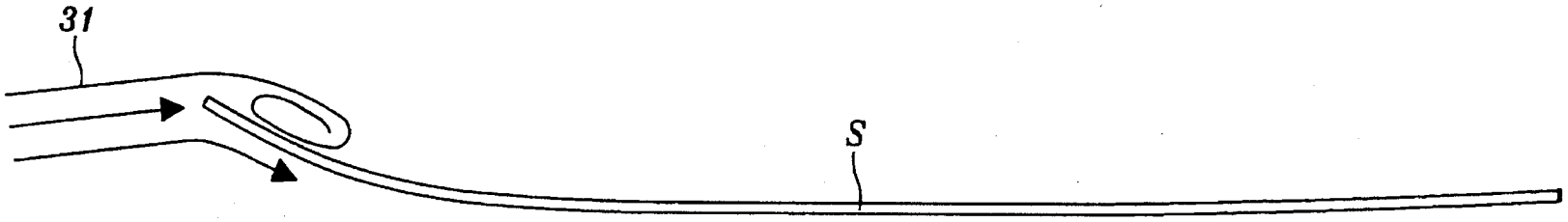
Fig. 17. (PRIOR ART)
FIG. 17 is a diagrammatic side elevation of a known jump ski illustrating airflow at the tip of the ski during a jump.
Figure 18:
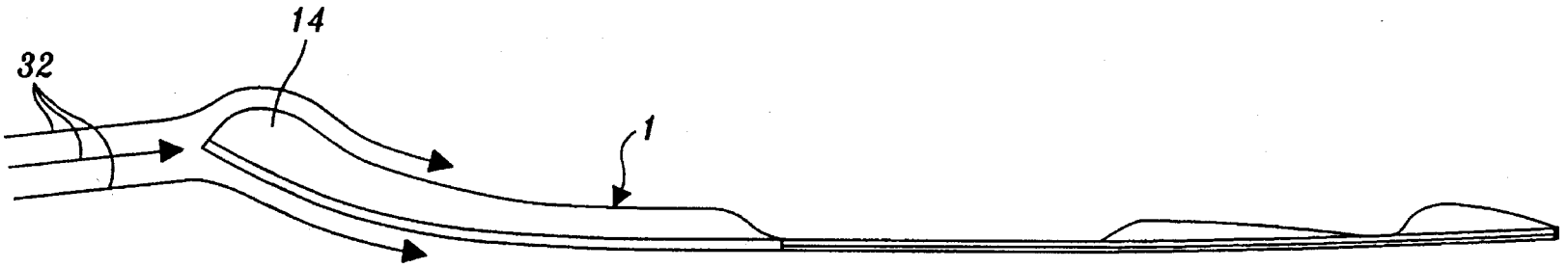
FIG. 18 is a corresponding diagrammatic side elevation of the jump ski in accordance with the present invention illustrating airflow at the tip of the ski during a jump.

With reference to FIG. 17, during a jump with a known ski S, the airflow over the top of the ski, represented by the reference line 31, is separated and turbulent for even a gradual angle of attack, thereby creating drag and negatively impacting on the distance of the jump. Reference lines 32 in FIG. 18 illustrate airflow over and under the tip of the improved ski 1 in accordance with the present invention. The effect of the bulbous nose portion 14 is to maintain attached flow and to induce a smoother, more laminar flow over the tip portion of the ski for a wide range of angles of attack. Lines 32 in FIG. 18 illustrate the flow for a small angle of attack, but at even a larger angle of attack, the airflow over the top surface of the ski is much smoother than for known skis having flat tops. In addition, the leading portion of the nose portion 14 curves upward and rearward abruptly as compared to the gradual downward tapering of the trailing portion of the nose portion. Viewed in profile, the nose portion is essentially airfoil shaped, aligned longitudinally of the ski, for increasing lift.

Figure 19:
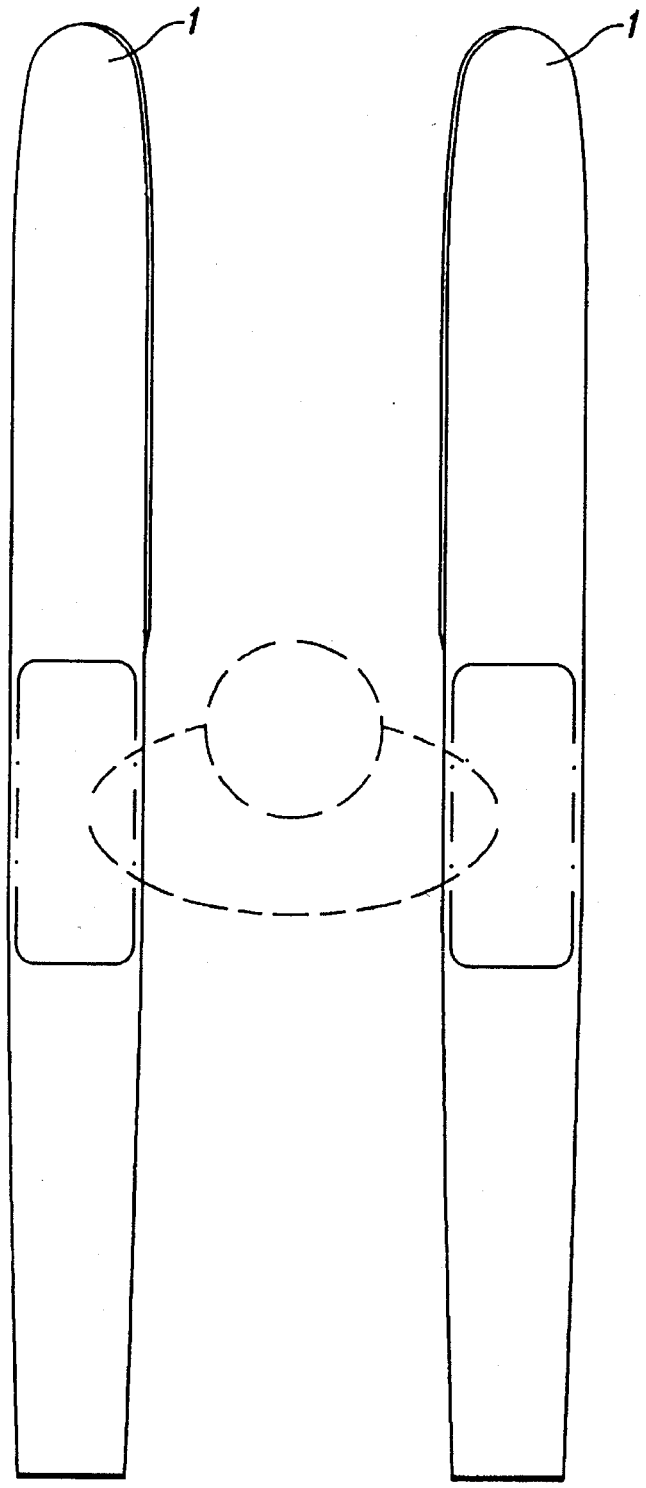
FIG. 19 is a somewhat diagrammatic top plan of a pair of jump skis in accordance with the present invention in approximately the relative positions of the skis at take-off.
Figure 20:
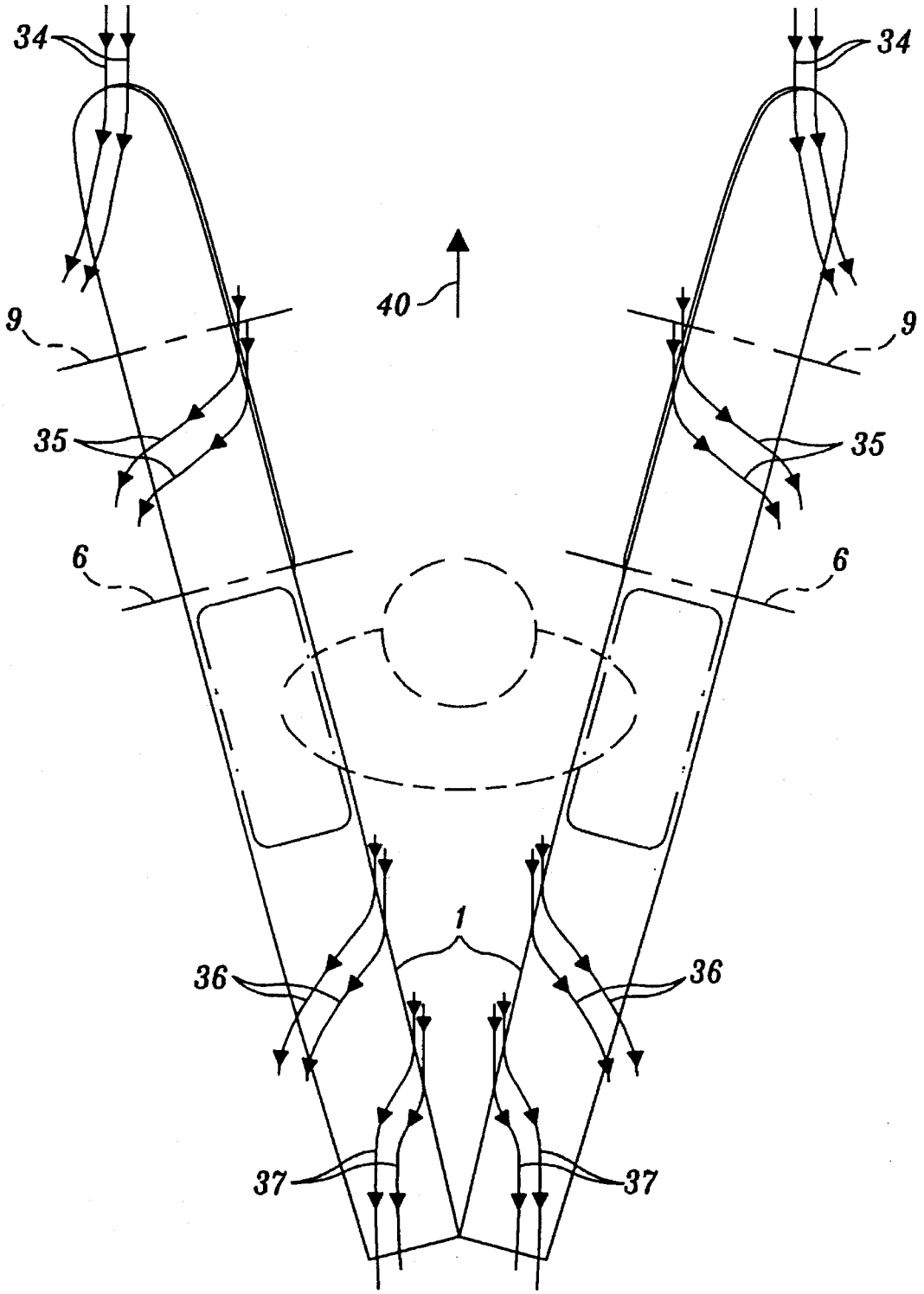
FIG. 20 is a somewhat diagrammatic top plan of a pair of jump skis in accordance with the present invention in approximately the preferred relative positions while in the air during a jump.

FIG. 19 illustrates the parallel relationship of the left and right skis 1 as the skier leaves the ramp. However, a skier with good technique promptly moves the skis to a splayed relationship as illustrated in FIG. 20. In aeronautical terms, the yaw angle of the skis is increased, such as to an angle of 15 degrees or more relative to the direction of travel. Airflow over the top surface of the skis is represented by the reference lines 34–37 in FIG. 20. At the tip portions of the skis, airflow represented by the lines 34 is generally parallel to the direction of travel represented by arrow 40. Farther rearward, however, but still in front of the boot area 5, there is a substantially transverse component of airflow relative to the skis as represented by reference lines 35. In that area, between the reference planes 9 and 6, air flows smoothly over the top surface of the ski in a direction at least partly transversely, from the inside edge of the ski toward the outside edge of the ski. The airfoil shape of the ski in that section reduces drag and increases lift.

In the middle portion of the ski, the binding interferes with airflow and does create some turbulence. Nevertheless, as represented by reference lines 36, there still is some transverse component immediately to the rear of the bindings which passes over the shorter transversely aligned airfoil section behind the binding. A higher transversely aligned airfoil contour in that area could block and separate the airflow and increase drag rather than reduce it.

At the tail portion of the ski, airflow has straightened out as represented by the reference lines 37 such that the direction of airflow is substantially parallel to the length of the ski. Lift is created by the longitudinally aligned airfoil tail section.

Overall, the contoured top of the ski in accordance with the present invention decreases drag and increases lift both in front and behind the ski binding.

Figure 21:
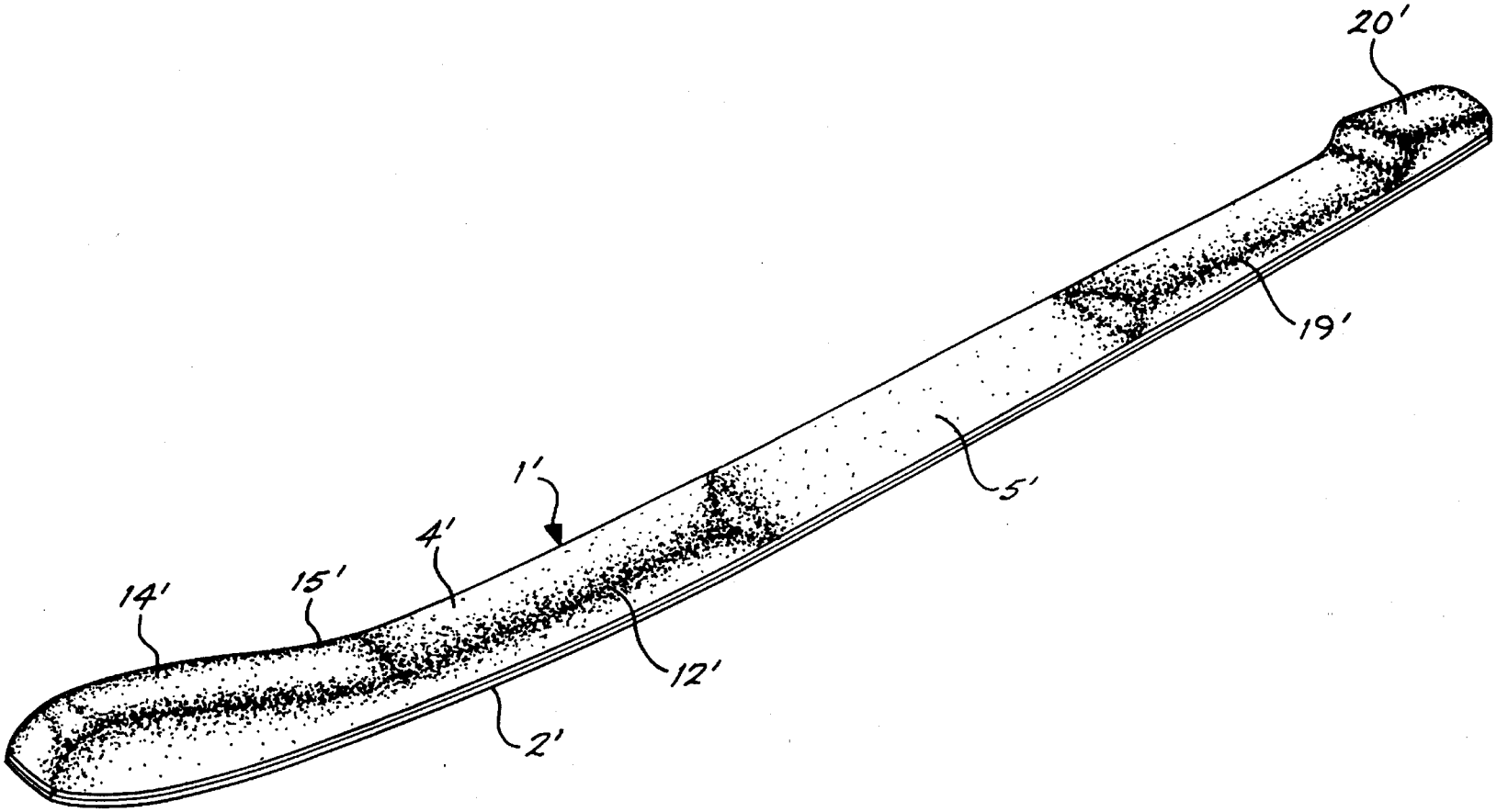
FIG. 21 is a top perspective of an airfoil snow ski in accordance with the present invention for use in snow ski jumping and ski flying.

FIG. 21 illustrates a snow ski 1' modified in accordance with the present invention. The snow ski has a base 2' formed by a conventional jump ski and an attached top fairing or shell 4' contoured aerodynamically similar to the water ski previously described. The top fairing includes a leading bulbous nose portion 14' followed by a transition portion 15' blending the nose portion into a transversely aligned airfoil section 12'. The binding area 5' can closely overly the flat top of the base. Behind the binding area, ski 1' includes another transversely aligned airfoil section 19', and the tail section 20' is of airfoil shape but aligned longitudinally of the ski to take advantage of the essentially longitudinal airflow at the tail. Performance of the ski 1' in the air is the same as for the water ski previously described.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An elongated jump ski having a longitudinal centerline and an aerodynamically contoured top asymmetrical relative to said centerline, said aerodynamically contoured top including a first portion of airfoil cross section aligned transversely of the length of the ski.

2. The ski defined in claim 1, in which the ski has a longitudinally extending inside edge, the first portion of airfoil cross section having a thick sharply curved portion disposed toward said inside edge of the ski.

3. The ski defined in claim 2, in which the ski has a central binding area, the first portion of airfoil cross section being disposed in front of the binding area.

4. The ski defined in claim 2, in which the aerodynamically contoured top includes a second portion of airfoil cross section aligned generally longitudinally of the ski.

5. The ski defined in claim 4, in which the ski has a central binding area, the second portion of airfoil cross section being disposed behind the binding area.

6. The ski defined in claim 4, in which the second portion of airfoil cross section has a thick sharply curved portion disposed toward the front of the ski.

7. The ski defined in claim 1, in which the aerodynamically contoured top includes a bulbous rounded nose adjacent to the tip of the ski.

8. The ski defined in claim 7 in which the nose is of approximately semielliptical transverse cross section.

9. A jump ski comprising an elongated base having a longitudinal centerline, said base having a bottom and opposite longitudinal edges for riding and maneuvering on a supporting surface, and an aerodynamically contoured fairing fitted on said base and forming the upper surface of the ski, said fairing being asymmetrical relative to said centerline of said base and having a first portion of airfoil cross section aligned transversely of the length of said base.

10. The ski defined in claim 9, in which the/hiring is a thin shell secured to the base, the thickness of the base being at least several times greater than the thickness of said shell.

11. The ski defined in claim 9, in which the base has a longitudinally extending inside edge, and including a baffle strip extending along said inside edge, said baffle strip having an abrupt corner spaced from the aerodynamically contoured fairing.

12. The ski defined in claim 9, in which the fairing has a rounded bulbous nose forming the upper surface of the tip portion of the ski.

13. The ski defined in claim 12, in which the nose is of approximately semielliptical transverse cross section.

* * * * *

UNITED STATES PATENT AND TRADEMARK OFFICE

CERTIFICATE OF CORRECTION

PATENT NO. : 5,464,358

DATED : November 7, 1995

INVENTOR(S) : W.J. Unger et al.

It is certified that error appears in the above-indentified patent and that said Letters Patent is hereby corrected as shown below:

| COLUMN | LINE | |
|---|---|---|
| 8 (Claim 4, | 10 line 1) | "2," should read --1,-- |
| 8 (Claim 8, | 22 line 1) | "7 in" should read --7, in-- |
| 8 (Claim 10, | 32 line 1) | "the/hiring" should read --the fairing-- |

Signed and Sealed this

Sixteenth Day of April, 1996

Bruce Lehman

*Attest:*

BRUCE LEHMAN

*Attesting Officer*

*Commissioner of Patents and Trademarks*